United States Patent [19]

Goldman et al.

[11] Patent Number: 4,566,000

[45] Date of Patent: Jan. 21, 1986

[54] IMAGE DISPLAY APPARATUS AND METHOD HAVING VIRTUAL CURSOR

[75] Inventors: Craig E. Goldman, Natick; Douglas A. Voorhies, Framingham, both of Mass.

[73] Assignee: Prime Computer, Inc., Natick, Mass.

[21] Appl. No.: 466,077

[22] Filed: Feb. 14, 1983

[51] Int. Cl.[4] ..... G09G 1/00

[52] U.S. Cl. ..... 340/709; 340/750; 340/734

[58] Field of Search ..... 340/709, 712, 716, 717, 340/721, 734, 750

[56] References Cited

U.S. PATENT DOCUMENTS

| | | | |
|---|---|---|---|
| 3,609,749 | 9/1971 | McClelland | 340/324 A |
| 3,739,347 | 6/1973 | Forsberg | 340/172.5 |
| 3,750,135 | 7/1973 | Carey et al. | 340/324 AD |
| 3,781,846 | 12/1973 | Eichelberger et al. | 340/324 A |
| 3,892,963 | 7/1975 | Hawley et al. | 250/231 R |
| 3,898,377 | 8/1975 | Fairbairn et al. | 178/6 |
| 3,911,419 | 10/1975 | Bates et al. | 340/324 AD |
| 4,041,467 | 8/1977 | Cota et al. | 364/900 |
| 4,086,632 | 4/1978 | Lions | 340/709 X |
| 4,103,330 | 7/1978 | Thacker | 364/200 |
| 4,103,331 | 7/1978 | Thacker | 364/200 |
| 4,118,695 | 10/1978 | Agawa et al. | 340/324 AD |
| 4,148,098 | 4/1979 | McCreight et al. | 364/200 |
| 4,169,262 | 9/1979 | Schwartz et al. | 340/750 X |
| 4,197,590 | 4/1980 | Sukonick et al. | 340/721 X |
| 4,228,430 | 10/1980 | Iwamura et al. | 340/750 X |
| 4,251,816 | 2/1981 | Eppley | 340/747 |
| 4,259,725 | 3/1981 | Andrews et al. | 340/709 X |
| 4,267,574 | 5/1981 | Vanden Broek | 364/520 |
| 4,295,135 | 10/1981 | Sukonick | 340/734 |
| 4,303,986 | 12/1981 | Lans | 364/900 |
| 4,317,956 | 3/1982 | Torok et al. | 178/18 |
| 4,345,313 | 8/1982 | Knox | 364/515 |
| 4,400,780 | 8/1983 | Nagao et al. | 340/734 X |
| 4,433,330 | 2/1984 | Furjanic | 340/750 |

*Primary Examiner*—Gerald L. Brigance
*Assistant Examiner*—Vincent P. Kovalick
*Attorney, Agent, or Firm*—Lahive & Cockfield

[57] ABSTRACT

Image display equipment has a memory element for storing a selected combinatorial function of a cursor pattern and image field existing at an addressed cursor position, and has a controllable selector for displaying, at the cursor field, either the image field or the combined cursor field and image pattern. A single display memory can store the image field, the cursor pattern, and the selected combination of cursor pattern and image field. Selection logic addresses the stored combination pattern in lieu of the image field to provide the desired cursor display at the addressed cursor position.

5 Claims, 2 Drawing Figures

IMAGE DISPLAY APPARATUS AND METHOD HAVING VIRTUAL CURSOR

BACKGROUND OF THE INVENTION

This invention relates to the display of a cursor pattern on electrical image processing equipment. More particularly, the invention provides a selectable and flexible cursor overlay on a displayed visual image, without disturbing the storage of the original image information.

Electrical image processing equipment is known which displays a program-selectable cursor with the display of image information. In one instance of bit-mapped graphic display equipment using a CRT display, the cursor information is combined with the image information during the preparation of each video field. The Alto computer system of Xerox Corporation is understood to employ such a cursor system. Aspects of that computer system are described in U.S. Pat. No. 4,103,331 entitled "Data Processing Display System"; U.S. Pat. No. 3,911,419 entitled "Controller for Cursor Positioning On A Display Medium"; U.S. Pat. No. 3,892,963 entitled "Transducer For A Display Oriented Pointing Device"; U.S. Pat. No. 3,898,377 entitled "Video Mixer"; U.S. Pat. No. 4,148,098 entitled "Data Transfer System With Disk Command Verification Apparatus"; and U.S. Pat. No. 4,103,330 entitled "Task Handling In A Data Processing Apparatus".

Also in the prior art is the disclosure in U.S. Pat. No. 4,345,313 entitled "Image Processing Method And Apparatus Having Digital Airbrush For Touch Up". That patent describes an image system which selectively increases and decreases the portion of a graphics display at a cursor position.

It is an object of this invention to provide apparatus and a method for the improved display of a cursor pattern on electronic image processing equipment. One particular is to improve the flexibility and the control of the display.

A further object of the invention is to provide such an improved display of a cursor pattern on electronic image processing equipment without disturbing the storage of the image information being displayed.

Another object of the invention is to attain the foregoing method and apparatus with relatively little modification of existing image processing equipment.

Other objects of the invention will in part be obvious and will in part appear hereinafter.

GENERAL DESCRIPTION

Image processing equipment according to the invention displays a cursor on a visual image by storing a combination of the image information at the cursor position and the cursor pattern. The combined information is stored in memory separate from the storage of the image information. Normally, the stored image information memory is applied to a cathode ray tube or other display device to produce the desired visual display. However, at the addressed cursor position of the display, the stored combination information is applied to the display device and thereby creates the visual display, in place of the stored image information.

The cursor size and shape can be changed essentially at will, simply by revising the stored combination information. The format with which the cursor pattern overlaps the image display also can be selected readily by selection of the logic function with which the image information is combined with the cursor pattern. Elementary examples include combining the image information and cursor pattern with an inclusive OR function and, alternatively, with an exclusive OR function. Software control of these functions is readily available.

In a preferred embodiment, a single display memory stores the image information in mapped format in an on-screen memory portion, stores the cursor pattern in mapped format in a first off-screen memory portion, and stores the combined cursor-and-image information in a second off-screen portion. The second off-screen memory portion is addressed, in lieu of the on-screen portion, to produce the visual display at any selected cursor position. In one implementation, a second memory address register is incremented in step with the memory address register that accesses the on-screen portion of the display memory. Selection logic responds to a cursor display command to read to the display device the combined information addressed by the second MAR, instead of the image information which the first MAR addresses.

This practice of the invention requires few additional components, and advantageously uses many system components for both image display and cursor display. Further, it maintains image information, which is stored in the on-screen portion of the display memory, intact in original form.

The invention can also be practice with the foregoing substitution of combined cursor and image information occuring selectively, such as only on alternate image refresh cycles, as one example.

The invention accordingly comprises the several steps and the relation of one or more of such steps with respect to each of the others, and the apparatus embodying features of construction, combinations of elements, and arrangements of parts adapted to effect such steps, all as exemplified in the following detailed disclosure, and the scope of the invention is indicated in the claims.

BRIEF DESCRIPTION OF DRAWING

For a fuller understanding of the nature and objects of the invention, reference should be made to the following detailed description and the accompanying drawing, in which.

DESCRIPTION OF ILLUSTRATED EMBODIMENT

Figure 1:
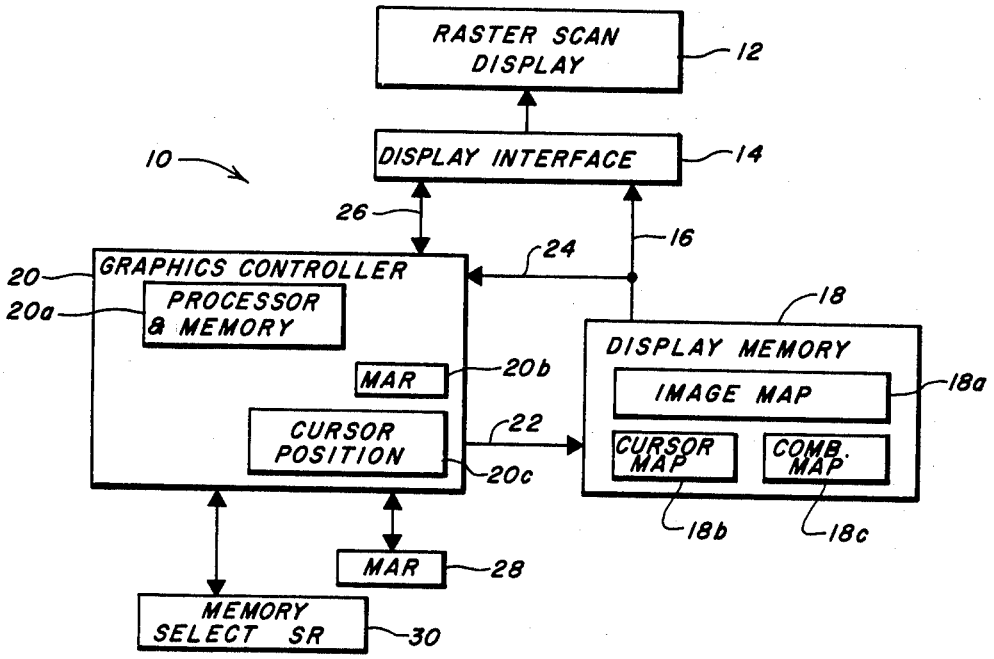
FIG. 1 is a block schematic representation of a raster scan display system according to the invention.

FIG. 1 shows a form of electrical image processing apparatus illustrated as a raster scan display system 10. The system has a CRT raster scan display device 12 which produces and displays a visual image in response to electrical signals. A display interface 14 serializes and synchronizes image representing signals received on a data line 16 from a display memory 18, and applies the signals to the CRT. The illustrated display memory 18 stores image information in conventional bit mapped format in an on-screen memory portion 18*a*. The display memory 18 also has two off-screen memory portions 18*b*, and 18*c*. The former stores information representing the cursor pattern in mapped format, and the latter portion stores information representative of a combination of the cursor pattern and of the image field at the addressed cursor position on the CRT display screen.

A graphics controller 20, typically of conventional construction with a processor and memory 20*a*, controls operation of the display memory 18 to send image information to the display interface 14. The graphics controller 20 also has a cursor position register 20*c* for storing information identifying the position on the CRT display screen where a cursor is to be displayed. For this operation the controller sends memory address signals to the display memory 18, as well as write signals and control signals, on line 22. The graphics controller receives read signals from the display memory on a line 24 and communicates control signals with the display interface 14 on line 26.

In a typical refresh of one field of the display on the CRT 12, the controller 20 controls a first memory address register (MAR) 20*b* to address locations in the image map portion 18*a* in selected succession to read out and send to the display interface 14 words representing the pixels which form one field of the displayed image.

The graphics controller 20 also operates the display memory 18 to store in the combination memory portion 18*c* a combination of the cursor pattern, as stored in the memory portion 18*b*, and the image field at the cursor position which the cursor position register 20*c* identifies.

The two sets of information, namely the cursor pattern and the image field at the cursor position, can be combined according to various selected formats. One such format is to combine the two sets of information with inclusive OR logic, and another is to combine the two data sets with exclusive OR logic. The combinatorial logic depends on the nature of the cursor display desired, and can be selected with operator input to the graphics controller 20, as by way of a keyboard, and by way of stored program instructions.

The display memory portion 18*c* is preferably loaded with combination information in mapped format during the retrace operation of the CRT 12, as occurs between successive refresh operations. The memory portion 18*c* can be loaded with a combination of cursor and image information during every retrace operation. An alternative is to load combination information only during retrace operations following a change in either the image field in memory portion 18*a*, a change in the cursor pattern in the memory portion 18*b*, or a change in the cursor position stored in the register 20*c*.

The illustrated display system 10 further has a second memory address register 28 which the graphics controller 20 uses to access a location in the combination map portion 18*c* of the display memory 18. The controller loads the MAR 28 and increments it, preferably in step with the incrementing of the first memory address register 20*b*. In particular, the controller, in a preferred operating sequence, initializes the second MAR 28 during each retrace operation of the CRT 12 with an address that is incremented to address the first word in the combination cursor and image map portion 18*c* at the same time that the first MAR 20*b* is incremented to address the first image word of the cursor position. Thus, whenever the first MAR 20*b* addresses a memory word in the image portion 18*a* corresponding to a display screen pixel within the cursor position, the second MAR 28 addresses the word in the combination map portion 18*c* which is to be displayed at that pixel.

The illustrated display system 10 further has a memory select shift register 30 connected with the controller 20 to produce a cursor display command whenever the display at a pixel of the cursor position is to be refreshed. In response to this command signal, the controller addresses the display memory from the second memory address register 28, rather than from the first memory address register 20*b*. The display memory 18, accordingly, receives the address of a word in the combination map portion 18*c*, and sends that word of combined image and cursor information for display on the CRT.

The system accordingly produces the visual image at any selected cursor position with combined cursor and image information from the memory portion 18*c*. The cursor display thus is the selected combination of image information with an overlay of the cursor pattern.

The memory select shift register 30 accordingly functions as a select device to select which portion of the display memory 18 is accessed to produce the display at any given pixel on the CRT display screen. In one preferred operating sequence, the controller 20 loads a fresh select word into the shift register 30 prior to the start of each refresh of a raster line on the CRT. Each select word is a multi-digit binary pattern which identifies the pixel-location in that line of the cursor position which the position register 20*c* stores. Thus, if the next line to be refreshed does not include any part of the cursor position, the shift register is located, for example, with a pattern of all ZEROS to indicate that no address identified by the second register 28 is to be used during the refresh of that display line. On the other hand, when the next line to be refreshed does include part of the cursor position, the controller 20 loads the shift register 30 with a pattern of ZEROS and ONES which identifies the size and the relative location of the cursor position which that display line includes.

The cursor pattern typically is a rectangle which covers the raster lines which form one line of text. The select word for such a cursor pattern is the same for each raster line within the rectangular pattern. The invention can be practiced with other cursor shapes which may require a different select word for different raster lines within the cursor position.

As the controller 20 addresses each pixel-specifying word in that raster line, and accesses the display memory 18 to send that word to the display interface 14, the shift register 30 is shifted and the end bit therein is examined by the controller. If the bit is a ZERO, the controller accesses the next memory word addressed by the first MAR 20*b*. On the other hand, if the shift register 30 end bit is a ONE, the controller addresses the next word of the display memory 18 from the second MAR 28, so that a pixel-specifying word from the combination information mapped in the memory portion 18*c* is sent to the display interface 14. (A pixel-specifying word may be considered any combination of (n) binary digits, and can specify ($2^n$) possible values for a pixel.) Thus, as each pixel-specifying word is sent to the interface 14 from the display memory 18, the graphics controller 20 increments both registers 20*b* and 28, and shifts the shift register 30 one position. The end bit of the register 30 is then examined to determine whether the next pixel-identifying word from the display memory 18 is to be selected from the mapped image information or from the mapped combination information. At the end of each raster line, the controller 20 loads a fresh pattern into the shift register and the process is repeated.

Figure 2:
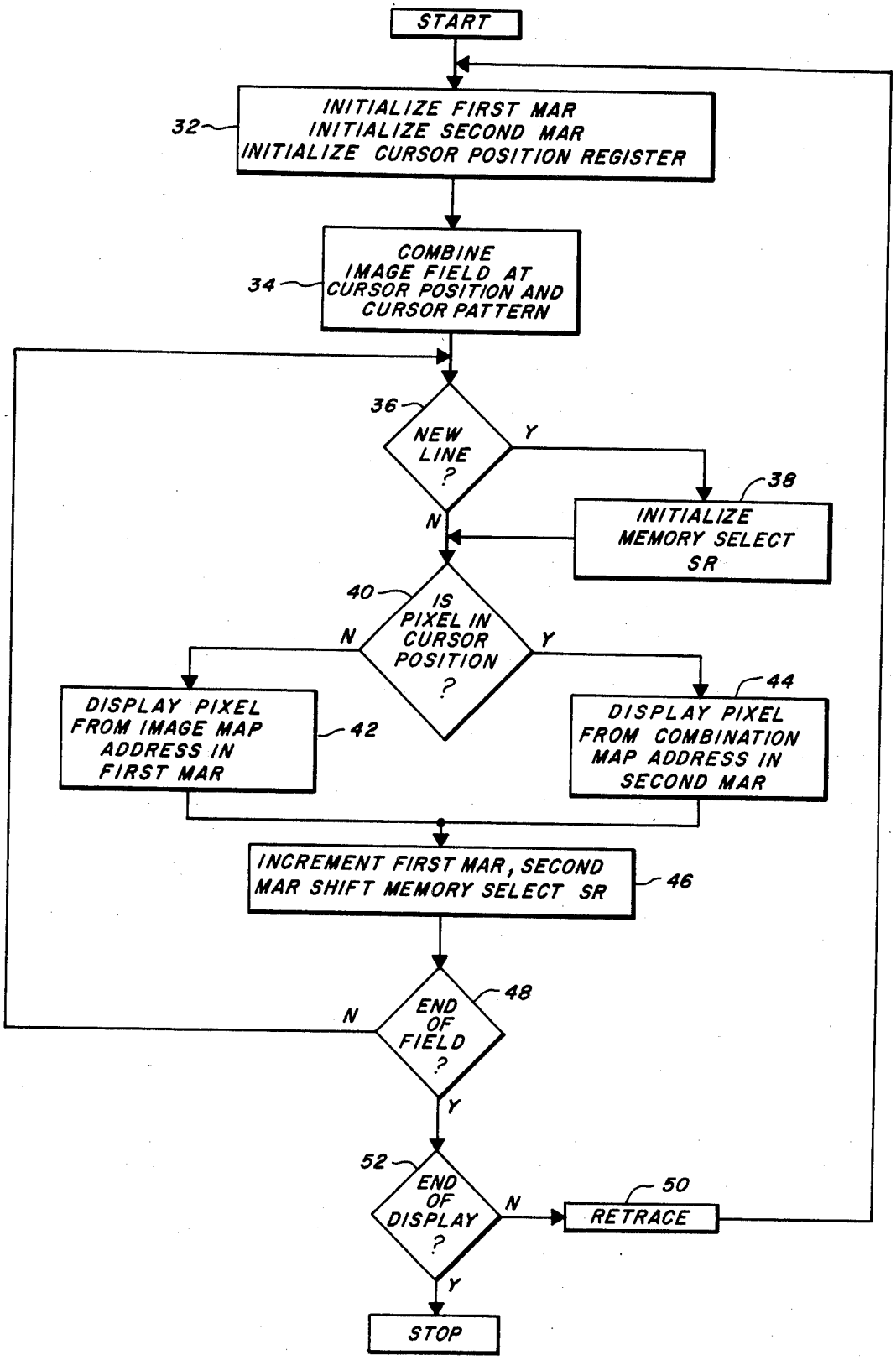
FIG. 2 is a simplified flow chart illustrating one portion of the invention with the system of FIG. 1.

The flow chart of FIG. 2 summarizes portions of one illustrative display-refreshing operating sequence as described for the system of FIG. 1. The illustrated operations commence with actions 32 that load selected addresses into MAR 20*b* and into MAR 28, and that initialize the cursor position register 20*c*. The illustrated flow-chart assumes that the memory image portion 18*a* already stores a field of image information and that the memory portion 18*b* already stores a cursor configuration, although either such information can be changed at this juncture. The next action 34 is the selected combining, and storage in the memory combination portion 18*c*, of the cursor pattern in memory portion 18*b* and the image information at the cursor position which register 20*c* stores.

The illustrated sequence next determines, with decision 36, whether the refresh operation is commencing a new line of the raster display. If so, the operation proceeds to action 38 and loads a memory select word for that line into the select register 30. The next illustrated operation is a determination, with decision 40, whether the pixel to be refreshed lies within the designated cursor position. In response to a negative decision, the operation proceeds to action 42 and displays, i.e. refreshes, that pixel according to the image word which the first MAR 20*b* addresses. An affirmative decision 40, on the other hand, directs the sequence to action 44 and causes the display of a pixel of information from a combination word read from the memory map portion 18*c*, as addressed by the second MAR 28. Where desired, the operating sequence can readily include a further decision to display only image information at the cursor position on selected refresh cycles, and to display the combined information on other refresh cycles. Also, decision 40 may be made once for a group of contiguous pixels in a raster line, rather than on a pixel-by-pixel basis as the flow chart of FIG. 2 illustrates.

The illustrated operation sequence next increments the registers 20*b* and 28, and shifts the register 30; action 46. If the last pixel refreshed is not at the end of a raster field, as determined with decision 48, the operation returns to decision 36. However, an affirmative end-of-field determination advances the sequence to a CRT retrace operation, action 50, unless the display is to end as determined with decision 52. In that event, the operation stops.

In this manner, the illustrated display system 10 displays on the CRT, in each pixel of a selected cursor position, a combination of the image information and the cursor pattern for that pixel. This combined information is read from a memory element separate from the display memory storage of the original image information. The selected combination of image information and cursor pattern is thereby effectively mapped over every pixel of the designated cursor position on the raster display screen. The cursor, selectively combined with the image information, appears in the proper display location without any overwriting of the on-screen display memory portion 18*a* with cursor information. Instead, the on-screen image-mapping memory portion 18*a* continues to contain only image information. The off-screen memory portion 18*c* at all times stores an up-to-date selected combination of the desired cursor pattern at the specified cursor position with the image information to be displayed at that position.

It will thus be seen that the objects set forth above, among those made apparent from the preceding description, are efficiently attained. Since certain changes may be made in carrying out the above method and in the construction set forth without departing from the scope of the invention, all matter contained in the above description or shown in the accompanying drawing is to be interpreted as illustrative and not in a limiting sense. It is also to be understood that the following claims are intended to cover all of the generic and specific features of the invention herein described, and all statements of the scope of the invention which, as a matter of language, might be said to fall therebetween.

Having described the invention, what is claimed as new and secured by Letters Patent is:

1. Electrical image processing apparatus comprising

A. memory means for storing concurrently (1) first signals representative of an image field, (2) second signals representative of a cursor pattern for display at an addressable cursor position on a display of the stored image field, and (3) third signals representative of a selected combinatoral function of said stored cursor pattern and of a segment of said stored image field at said addressable cursor position, B. image display means coupled for receiving signals stored in said memory means and arranged for producing a visual image in response to signals applied to it, and C. control means coupled with said memory means and responsive to a cursor display command for applying to said display means either of said stored first signals or said stored third signals to produce said visual image and to include therein a selective display of said cursor pattern combined with said image field at an addressed cursor position.

2. Image processing apparatus according to claim 1,

A. in which said memory means includes a display memory, (1) having an on-screen portion storing said first signals in mapped format, (2) having a first off-screen portion storing said second signals in mapped format, and (3) having a second off-screen portion storing said third signals in mapped format, and B. in which said control means includes select logic means responsive to said addressed cursor position for either accessing a location in said on-screen memory portion, for displaying the stored image field, or accessing a location in said second off-screen memory portion, for the display of said cursor pattern combined with said image field.

3. In a raster graphics display apparatus having a raster display device for displaying a visual image responsive to image field signals stored in an image-mapped portion of a display memory which is accessed under control of a first memory address register, and for displaying at an addressable cursor position on the displayed visual image a cursor responsive to cursor pattern signals stored in a cursor-mapped portion of said display memory, and wherein the display memory stores image field signals on a pixel-by-pixel basis, the improvement comprising A. a cursor-combination mapped portion of said display memory, B. means for storing in said further cursor-combination memory portion signals representative of a selected combinatorial function of said stored cursor pattern signals and of said stored image field signals for the image segment at the addressable cursor position, C. a further memory address register for addressing said further cursor-combination memory portion with a memory address having selected reference to a pixel of a cursor position which said first memory address register addresses, and D. controllable select means for accessing said display memory selectively under control of either of said first memory address register, for the display of the image field, or of said further memory address register, for the display of the cursor pattern combined with said image field at the addressed cursor position.

4. An electrical image processing method comprising the steps of

A. concurrently storing in memory means (1) first signals representative of an image field, (2) second signals representative of a cursor pattern for display at an addressable cursor position on a display of the stored image field, and (3) third signals representative of a selected combinatiorial function of said stored cursor pattern and of the segment of said stored image field at said addressable cursor position, B. producing a visual image in response selectively to either of said first stored signals or said third stored signals, and C. responding to a cursor display command to selectively produce a display of said cursor pattern combined with said image field at an addressed cursor position.

5. A method according to claim 4 comprising the further steps of

A. storing said first signals in mapped format in an on-screen portion of a display memory, storing said second signals in mapped format in a first off-screen portion of said display memory, and storing said third signals in mapped form in a second off-screen portion of said display memory, and B. selectively accessing either of said on-screen memory portion, for displaying the stored image field, or said second off-screen memory portion, for displaying the cursor pattern combined with the image field.

* * * * *